US006469429B1

(12) United States Patent
Berton

(10) Patent No.: US 6,469,429 B1
(45) Date of Patent: Oct. 22, 2002

(54) COLOR SELECTION MASK FOR A CATHODE-RAY TUBE

(75) Inventor: Fabrizio Berton, Segni (IT)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/667,479

(22) Filed: Sep. 22, 2000

(30) Foreign Application Priority Data

Sep. 24, 1999 (IT) ..... MI99A1992

(51) Int. Cl.[7] ..... H01J 29/80
(52) U.S. Cl. ..... 313/402; 313/404
(58) Field of Search ..... 313/402, 403, 313/404, 405, 406, 407, 408

(56) References Cited

U.S. PATENT DOCUMENTS 4,827,179 A * 5/1989 Adler et al. ..... 313/402
5,451,833 A * 9/1995 Tong ..... 313/402

FOREIGN PATENT DOCUMENTS

JP P2000-77007 A 3/2000 ..... H01J/29/07

* cited by examiner

*Primary Examiner*—Nimeshkumar D. Patel
*Assistant Examiner*—Thelma Sheree Clove
(74) *Attorney, Agent, or Firm*—Joseph S. Tripoli; Dennis H. Irlbeck; Carlos M. Herrera

(57) ABSTRACT

A color cathode-ray tube comprises a mask, intended for selecting the colors, which is tensioned on a support frame, the frame/mask assembly including means for preventing the tensioned mask from vibrating under the influence of external vibrations. These means comprise at least one mechanical oscillator, coupled to the mask, in the form of metal strips produced by partial cutting of the surface of the peripheral region of the mask.

12 Claims, 4 Drawing Sheets

COLOR SELECTION MASK FOR A CATHODE-RAY TUBE

The present invention relates to a colour selection mask structure for a colour cathode-ray tube and, more particularly, to a mask structure designed to be held under tension inside such a tube.

The invention is applicable in any type of tube having a colour selection mask and is particularly suitable for tubes whose mask is held under tension by the frame to which it is fastened.

BACKGROUND OF THE INVENTION

Conventional cathode-ray tubes include a colour selection mask located at a precise distance from the inside of the glass faceplate of the tube, on which faceplate arrays of red, green and blue phosphors are deposited in order to form a screen. An electron gun placed inside the tube, in its rear part, generates three electron beams in the direction of the faceplate. An electromagnetic deflection device, generally placed outside the tube and close to the electron gun, has the function of deflecting the electron beams so as to make them scan the surface of the panel on which the arrays of phosphors are arranged. Under the influence of the three electron beams, each corresponding to a predetermined primary colour, the arrays of phosphors make it possible to reproduce images on the screen, the mask allowing each beam to illuminate only the phosphor of the corresponding colour.

The colour selection mask must be placed in a precise position inside the tube and supported therein during the operation of the tube. The support functions of the mask are achieved by means of a generally very rigid rectangular metal frame to which the mask is conventionally welded. The frame/mask assembly is mounted in the faceplate of the tube using suspension means welded to the frame and interacting with pins inserted into the glass forming the faceplate of the tube.

The tubes, whose faceplates are becoming increasingly planar, correspond to the current trend towards completely flat faceplates. Tubes having such faceplates are produced using a technology which uses a planar mask, supported under tension in at least one direction. Such structures are described, for example, in U.S. Pat. No. 4,827,179, issued to Adler et al., on May 2, 1989.

Inasmuch as the colour selection mask consists of a very thin metal foil, putting it under tension may generate undesirable vibration phenomena in the mask during operation of the tube. Due to the effect of external mechanical vibrations or shock, for example, acoustic vibrations caused by the loudspeakers of the television set into which the tube is inserted, the mask may vibrate at its natural resonant frequency. Consequently, the vibrations of the mask modify the region of impingement by the electron beams on the screen of the tube, the points of impact of each beam then being offset with respect to the associated phosphor array, thus creating a discoloration of the image reproduced on the screen.

U.S. Pat. No. 4,827,179 proposes adding to the surface of the mask means for damping the vibration of the mask. However, the dampers used in that patent have a complicated structure. Likewise, their use is itself complicated, because the means are installed after the mask has been fastened to the frame, thereby complicating the process for manufacturing the tube by adding steps. Moreover, it is not desirable to add elements to the surface of the mask after it has been tensioned, because its small thickness makes it very fragile and fastening elements to its surface may easily damage it.

Therefore, there is a need for a cathode-ray tube comprising, a mask structure with damping means not having the above-mentioned drawbacks.

SUMMARY OF THE INVENTION

A tube according to the present invention comprises:

a colour selection mask in the form of an approximately rectangular metal foil, designed to be fastened under tension to a support frame and mounted inside the faceplate of the tube, the mask having a central region with holes and a peripheral region lying between the central region and the edges of the mask, the mask being capable of vibrating independently of the support frame, and means for damping the vibrations of the mask, these means being placed around the periphery of the mask, wherein the damping means comprise at least one mechanical oscillator in the form of a metal strip produced by partially cutting the surface of the peripheral region of the mask.

DESCRIPTION OF PREFERRED EMBODIMENTS OF THE INVENTION

Figure 1:
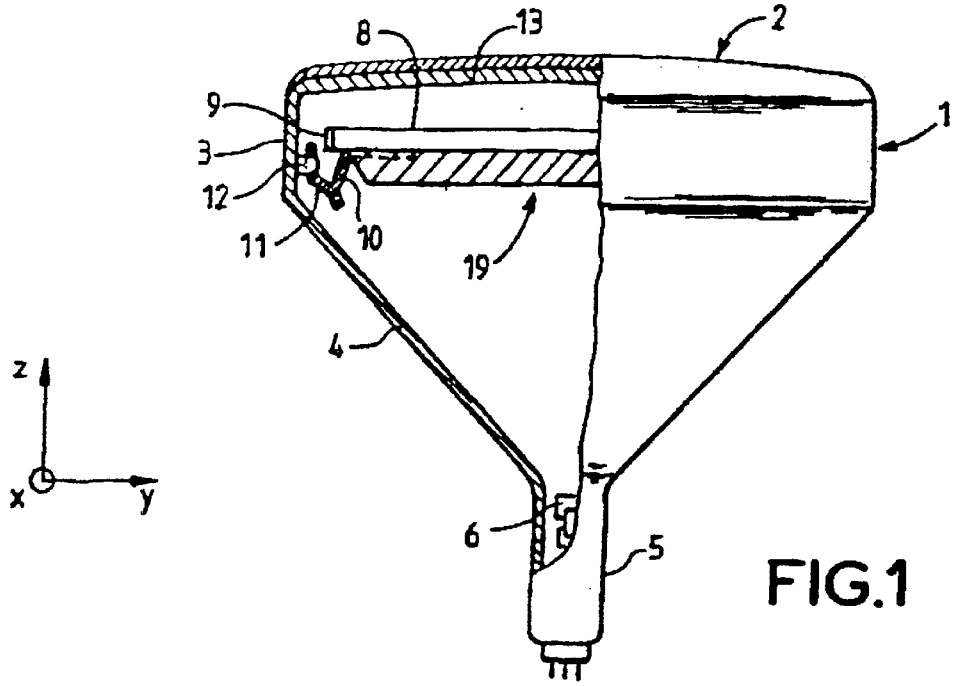
FIG. 1 shows a cathode-ray tube according to the invention, in a partially exploded view.

As illustrated in FIG. 1, a cathode-ray tube 1 according to the invention comprises an approximately planar panel 2 and a peripheral skirt 3. The panel is connected to a funnel-shaped rear part 4 of the tube by a glass-frit seal. An end part 5 of the tube surrounds an electron gun 6, the beams from which illuminate a screen 13 of luminescent phosphors through a colour selection mask 8. In this case, the mask 8 is planar, and tensioned between the long sides 9 of a frame 19. Metal supports of the frame/mask assembly support this assembly inside the tube, the supports comprising a part 10 welded to the frame and a part forming a spring 11, which spring-forming part is provided with an aperture for interacting with a pin 12 included in the glass skirt 3.

Figure 2:
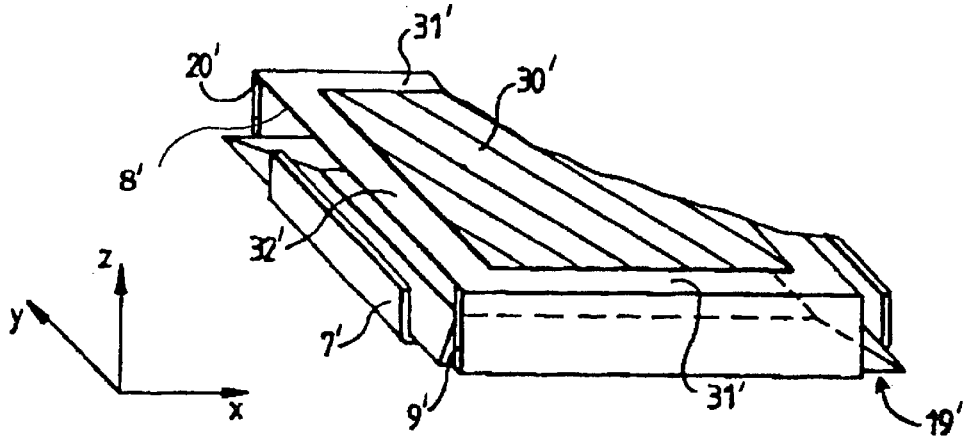
FIG. 2 PRIOR ART
FIG. 2 describes a frame/tensioned-mask assembly according to the prior art, without a vibration damper.

In the example of the prior art illustrated by FIG. 2, a frame 19' comprises a pair of long sides 9' and a pair of short sides 7', the long and short sides having L-shaped cross sections. A mask 8', itself of approximately rectangular shape, is tensioned and then maintained in that state, for example, by welding it to the ends 20' of the long sides of the frame.

The mask 8' consists of a metal foil, made of steel or Invar, with a very small thickness of the order of 100 $\mu$m. The mask has a central region 30' with holes generally arranged in columns, and a peripheral region surrounding the central region with horizontal edges 31' and vertical edges 32'.

The cathode-ray tube structures using tensioned colour selection masks have to confront the problem of vibration of this mask, in modes which are natural modes of the mask when the latter is excited by external vibrations, for example, by mechanical shocks to the tube or sound vibrations coming from loudspeakers placed near the tube. Inasmuch as these vibrations result in movements of the mask in a direction perpendicular to its surface, the distance between the holes in the mask and the screen varies locally depending on the amplitude of the vibration of the mask. The purity of the colours reproduced on the screen is therefore no longer guaranteed, the points of impingement of the beams on the screen being shifted depending on the amplitude of the vibration.

Moreover, because the mask is placed inside the tube in which a high vacuum is created, the vibrations of the mask are damped only very slowly, the energy communicated to the mask having few means of dissipation, thereby increasing the visibility of the phenomenon on the screen when the tube is in operation.

Figure 3:
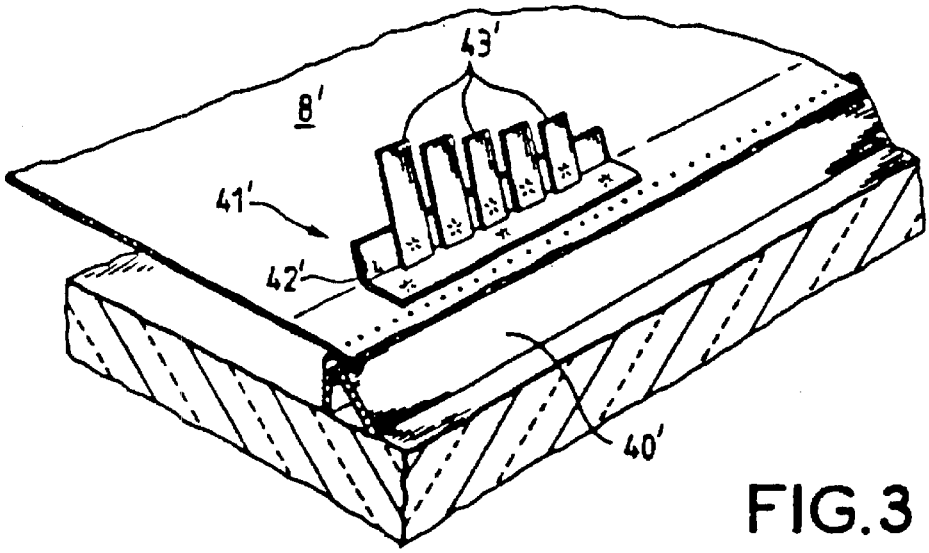
FIG.3 PRIOR ART
FIG. 3 is a perspective view of an embodiment of a vibration damper according to the prior art.

As illustrated in FIG. 3, U.S. Pat. No. 4,827,179 proposes a solution for damping the vibrations of the mask, using a device 41' forming a coupled oscillator, by placing along the edges of the mask 8', near the region where the mask is welded to the frame 40', a mechanical structure having a rigid support 42' to which at least one flexible strip 43' is welded. The natural resonant frequency of the device 41' is chosen so as to damp the vibrations of the mask in a predetermined frequency band according to the principle of coupled oscillators.

However, this structure has a certain number of disadvantages:

It is expensive, because it requires additional mechanical components and it complicates the process for manufacturing the tube by adding a step, namely, that of fastening the device 41' to one surface of the mask; and It is of limited use, because the device 41' can be used only near the region where the mask is welded to the frame, the frame reinforcing the solidity of the mask at this point. This is because most of the frame/mask structures are such that the mask is welded to the frame only at two parallel edges, for example, the horizontal edges 31'. The free vertical edges are fragile because of the small thickness of the mask, and the fastening of a device, such as an oscillator 41', can damage its surface, causing the frame/mask assembly thus produced to be rejected.

The present invention provides a simple, inexpensive and easily implementable structure for damping the vibrations of a mask tensioned in one or two directions.

Figure 5:
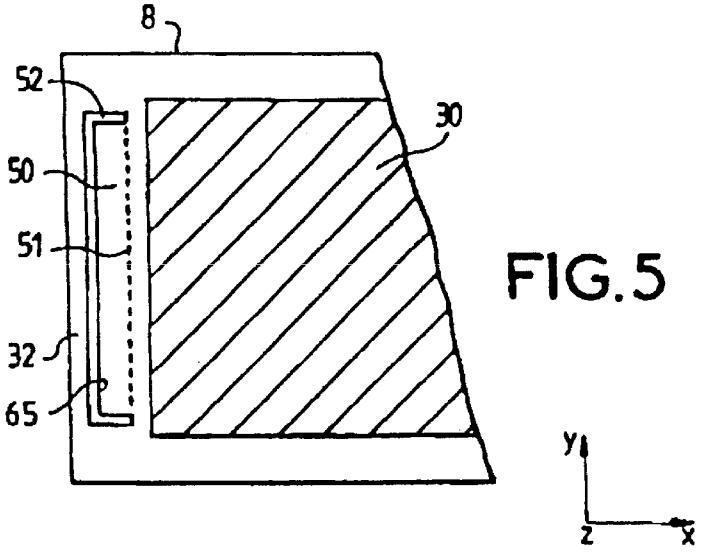
FIGS. 5 to 10 illustrate various embodiments of the invention.

FIG. 5 illustrates a first embodiment of the invention. Cut in the surface of the peripheral part of the mask, for example, along the short vertical sides 32, is a metal strip 50 which remains linked to the mask at one of its ends 51 and is approximately parallel to the vertical direction of the short side 32 of the mask. The strip 50 has a shape and an area designed so as to be able to vibrate in a direction approximately perpendicular to the surface of the mask, at a predetermined natural frequency, so as to damp the natural frequency of the mask in the frequency range which would be capable of exciting it.

Figure 6:
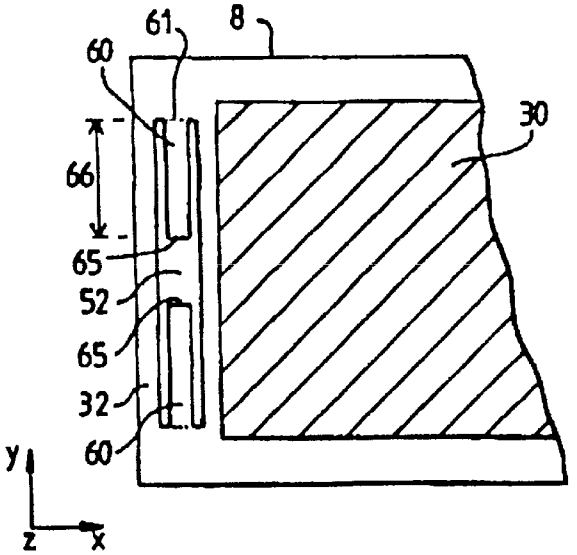

In a second embodiment, illustrated in FIG. 6, the strip intended to form a coupled oscillator is produced in such a way that its end 61 for connection to the mask is approximately parallel to the horizontal direction of the long sides 31 of the mask. One or both strips may be produced on each short side 32. If two metal strips 60 are placed on each short side, it is advantageous for the free ends 65 of the strips to be arranged so as to face each other. It is possible to adjust the length 66 of the strip, to bring the natural vibration frequency of the strip to a predetermined value to damp the vibrations of the apertured part 30 of the mask.

Figure 7:
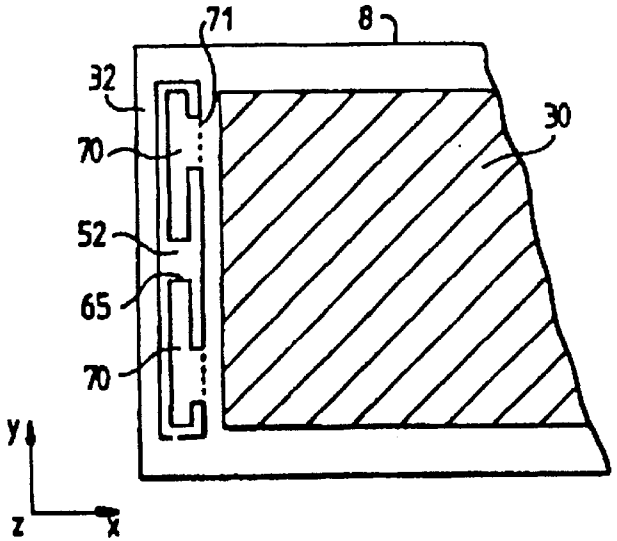

In a third embodiment, illustrated in FIG. 7, the metal strip 70 intended to form an oscillator coupled with the mask is connected to the mask by a region 71 approximately parallel to the short side of the mask, but extending in this direction over a shorter length than the strip 70. Also in this case, two strips 70 may be placed in such a way that their free ends 65 are arranged so as to face each other.

The shapes of the cut parts of the edges of the mask, as well as the number of strips forming an oscillator, are chosen so as to obtain the resonant frequency most appropriate to damping the vibrations of the mask.

Figure 9:
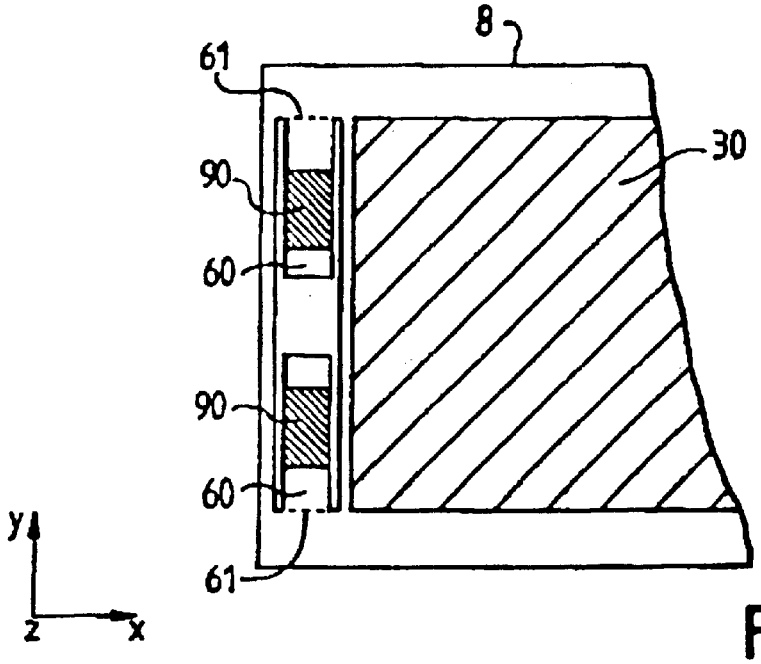

The mass of the strip is another criterion which determines its resonant frequency. It may be necessary to obtain a strip whose mass is greater than the maximum mass that can be obtained from the material of which the mask is composed. In such a case, the mass of the strip 60 can be increased by depositing a coating 90 on one or both faces of the strip 60, as illustrated in FIG. 9. This coating may advantageously be produced using inert materials, for example, those based on glass-frit or on heavy metals, such as tungsten or molybdenum.

Figure 10:
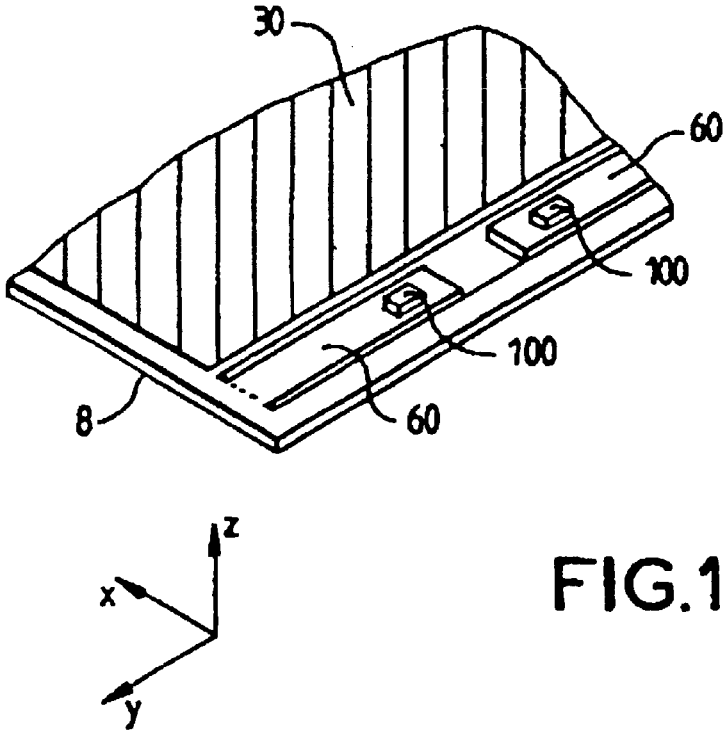

Also in the case in which it is desirable to increase the mass of the strip forming an oscillator, it is possible to position one or more weights 100, as indicated in FIG. 10, in order to adjust the resonant frequency of the strip 60. These weights may be made of metal and fastened to the strip or strips 60 by welding. The weights may also be placed on any type of strip cut in the peripheral region of the mask, such as those illustrated in FIGS. 5 to 8.

Figure 8:
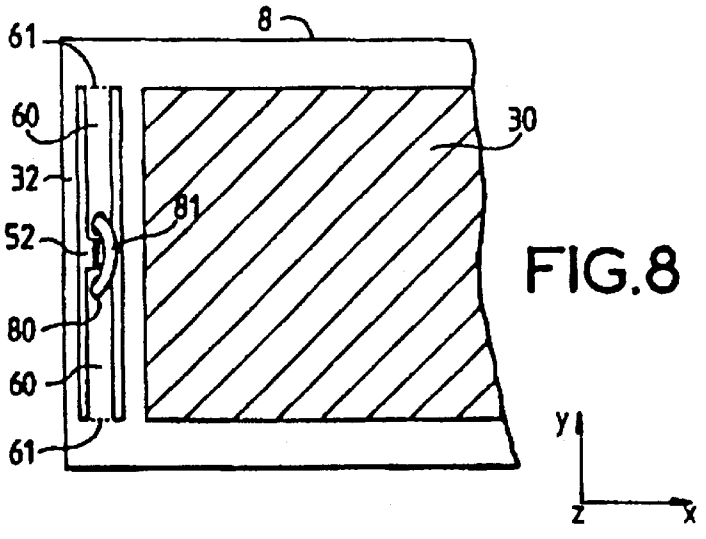

The invention provides a structure allowing simple implementation of the means of dissipating the energy communicated to the mask upon an impact to the tube or via powerful sound waves. This is because the vibrations communicated to the mask, even if they are of low amplitude, must be prevented from lasting too long a time inasmuch as they then become visible during the operation of the tube. Because the mask lies inside the tube in which a high vacuum is created, it is necessary to add energy-dissipation means so that the mask is rapidly damped. It is, for example, advantageous to add, to a metal strip 50, 60, or 70 forming a coupled oscillator, at least one metal hoop 81 passing through a hole 80 made in the strip. The hoop may be open or closed, the diameter of its cross section being slightly less than the diameter of the hole 80 so as to be able to move in this hole and dissipate the energy by friction against the edge of the hole. As illustrated in FIG. 8, the hoop 81 may advantageously pass through the facing two ends of two strips 60 forming coupled oscillators, an arrangement allowing more rapid frictional dissipation with a single hoop 81.

In another embodiment (not illustrated), rivets are placed so as to pass through the metal strips, through holes 80 made in the latter, the heads of the rivets being larger in size than the holes, while the body of the rivet has a diameter smaller than the diameter of the hole.

The arrangement of strips forming a coupled oscillator along the short sides 32 of the mask is not limiting. It results, for example, from the choice of the value of the tension applied to the mask and from the aspect ratio of the mask, i.e., 4/3, 16/9, or another.

Figure 4:
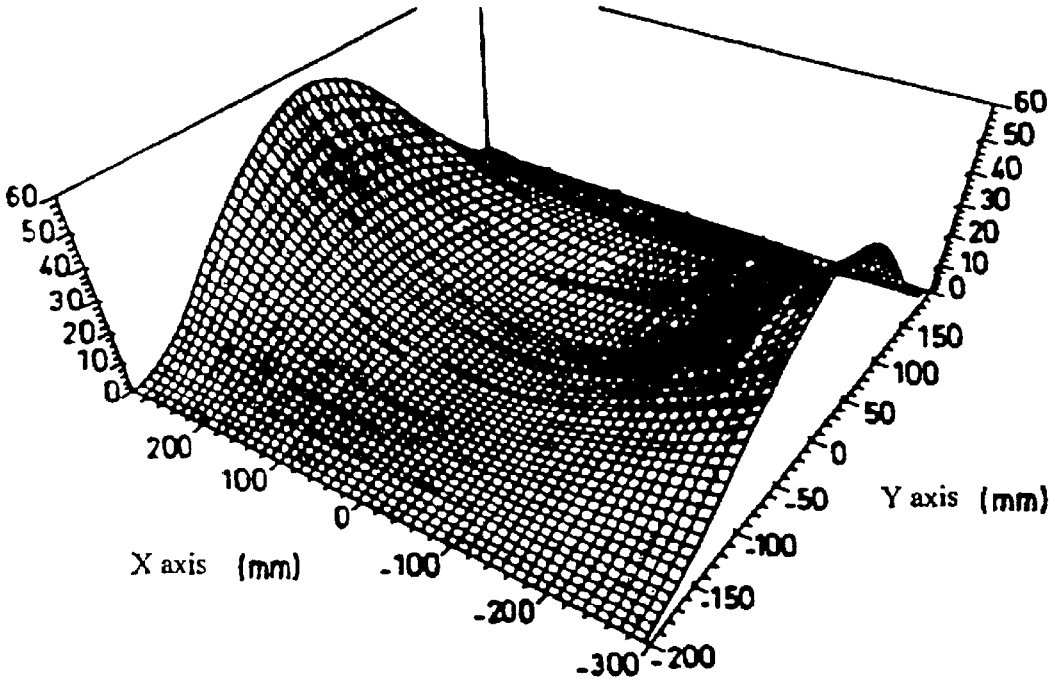
FIG. 4 illustrates the displacement profile of the surface of a tensioned mask subjected to vibrations.

FIG. 4 is a plot of the oscillation amplitudes of a mask for a tube whose screen has a 16/9 aspect ratio and a diagonal of 76 cm. The mask is tensioned in only one direction and is maintained under tension by being welded along the long sides of the frame 19; moreover, it has a resonant frequency close to 100 Hz. In this figure, it may be seen that these oscillations have a maximum amplitude at the mid-point of the short vertical sides of the mask. The structure of the strips forming coupled oscillators is, in a preferred embodiment, tailored to these conditions. With respect to the one illustrated in FIG. 6, the strip 60 has a length 66 of 34.7 mm, a width of 4 mm and a thickness of 0.2 mm.

For other mask tensions and other aspect ratios, the metal strips 50, 60, or 70 could advantageously be placed along the long sides of the mask.

Likewise, if the mask is tensioned in two directions parallel to its length and its width, it is advantageous to place vibration dampers along both the horizontal and vertical sides of the mask.

The metal strips forming a coupled oscillator may be cut, for example, by stamping, when cutting the outer edges of the mask, or by etching, during the same manufacturing step as that for producing the apertures in the apertured central part 30. In either case, there is no need for an additional step to produce the cut part 52. However, given the small thickness of the mask, etching may be more advantageous than stamping as the former is mechanically less aggressive and is not limited in the shapes and sizes of the strips to be produced.

What is claimed is:

1. A colour cathode-ray tube comprising:

a colour selection mask in the form of an approximately rectangular metal foil, designed to be fastened under tension to a support frame and mounted inside a faceplate of the tube, said mask having a central region with holes and a peripheral region lying between the central region and the edges of the mask, said mask being capable of vibrating independently of the support frame;

means for damping the vibrations of the mask along said periphery of the mask;

wherein the damping means comprise at least one mechanical oscillator in the form of a metal strip cut along the surface of the peripheral region of the mask.

2. The cathode-ray tube according to claim 1, wherein one end of said metal strip is free to move in a plane perpendicular to the plane of the mask.

3. The cathode-ray tube according to claim 1 or 2, wherein said at least one mechanical oscillator is in the form of a metal strip cut along a short side of the mask.

4. The cathode-ray tube according to claim 3, wherein the mask has, on each of its short sides, two mechanical oscillators in the form of parallel metal strips, the free ends of which face each other.

5. The cathode-ray tube according to claim 1, wherein said at least one mechanical oscillator includes friction-based energy-absorbing means.

6. The cathode-ray tube according to claim 5, wherein the friction-based energy-absorbing means comprise a hoop passing through a hole made through a strip forming a mechanical oscillator.

7. The cathode-ray tube according to claim 6, wherein the hoop links two free ends of two mechanical oscillators facing each other.

8. The cathode-ray tube according to claim 1, wherein all or part of a face of a metal strip forming a mechanical oscillator is covered with a coating so as to bring its resonant frequency to a predetermined value.

9. The cathode-ray tube according to claim 8, wherein the coating consists of a metal layer comprising a heavy metal.

10. The cathode-ray tube according to claim 1, wherein at least one weight is placed on one face of a metal strip forming a mechanical oscillator so as to bring its resonant frequency to a predetermined value.

11. The cathode-ray tube according to claim 1, wherein the metal strip forming a mechanical oscillator is produced by etching the metal foil of which the mask is composed.

12. The cathode-ray tube according to claim 11, wherein the strip forming a mechanical oscillator is etched at the same time as the holes in the central region of the mask.

* * * * *